United States Patent [19]

Radaelli

[11] Patent Number: 4,625,696

[45] Date of Patent: Dec. 2, 1986

[54] PRESSURE REGULATOR FOR A PETROL INJECTION SYSTEM

[75] Inventor: Dario Radaelli, Legnano, Italy

[73] Assignee: Alfa Romeo Auto S.p.A., Napoli, Italy

[21] Appl. No.: 700,953

[22] Filed: Feb. 12, 1985

[30] Foreign Application Priority Data

Feb. 23, 1984 [IT] Italy ..... 19779 A/84

[51] Int. Cl.[4] ..... F02M 39/00

[52] U.S. Cl. ..... 123/463; 123/465; 123/512; 123/514

[58] Field of Search ..... 123/463, 465, 456, 514, 123/511, 512, 513

[56] References Cited

U.S. PATENT DOCUMENTS

| | | | |
|---|---|---|---|
| 2,378,036 | 6/1945 | Reggio | 123/463 |
| 2,440,567 | 4/1948 | Armstrong | 123/463 |
| 2,888,000 | 5/1959 | Winkler | 123/465 |
| 2,954,020 | 9/1960 | Ball | 123/463 |
| 2,988,077 | 6/1961 | Hottenroth | 123/463 |
| 4,231,347 | 11/1980 | Ohumi | 123/512 |
| 4,300,509 | 11/1981 | Schechter | 123/456 |

FOREIGN PATENT DOCUMENTS

| | | | |
|---|---|---|---|
| 1465275 | 2/1977 | United Kingdom | 123/463 |

*Primary Examiner*—Carl Stuart Miller

*Attorney, Agent, or Firm*—Charles E. Brown; Charles A. Brown

[57] ABSTRACT

The pressure regulator comprises a valving element caused to open or close a bleed port of the petrol circuit, and a diaphragm subjected to the pressure of said petrol and to a pressure which is a function of the engine intake pressure, said diaphragm being balanced by a force due to the action of an aneroid capsule also subjected to said pressure which is a function of the intake pressure.

5 Claims, 2 Drawing Figures

PRESSURE REGULATOR FOR A PETROL INJECTION SYSTEM

Figure 1:
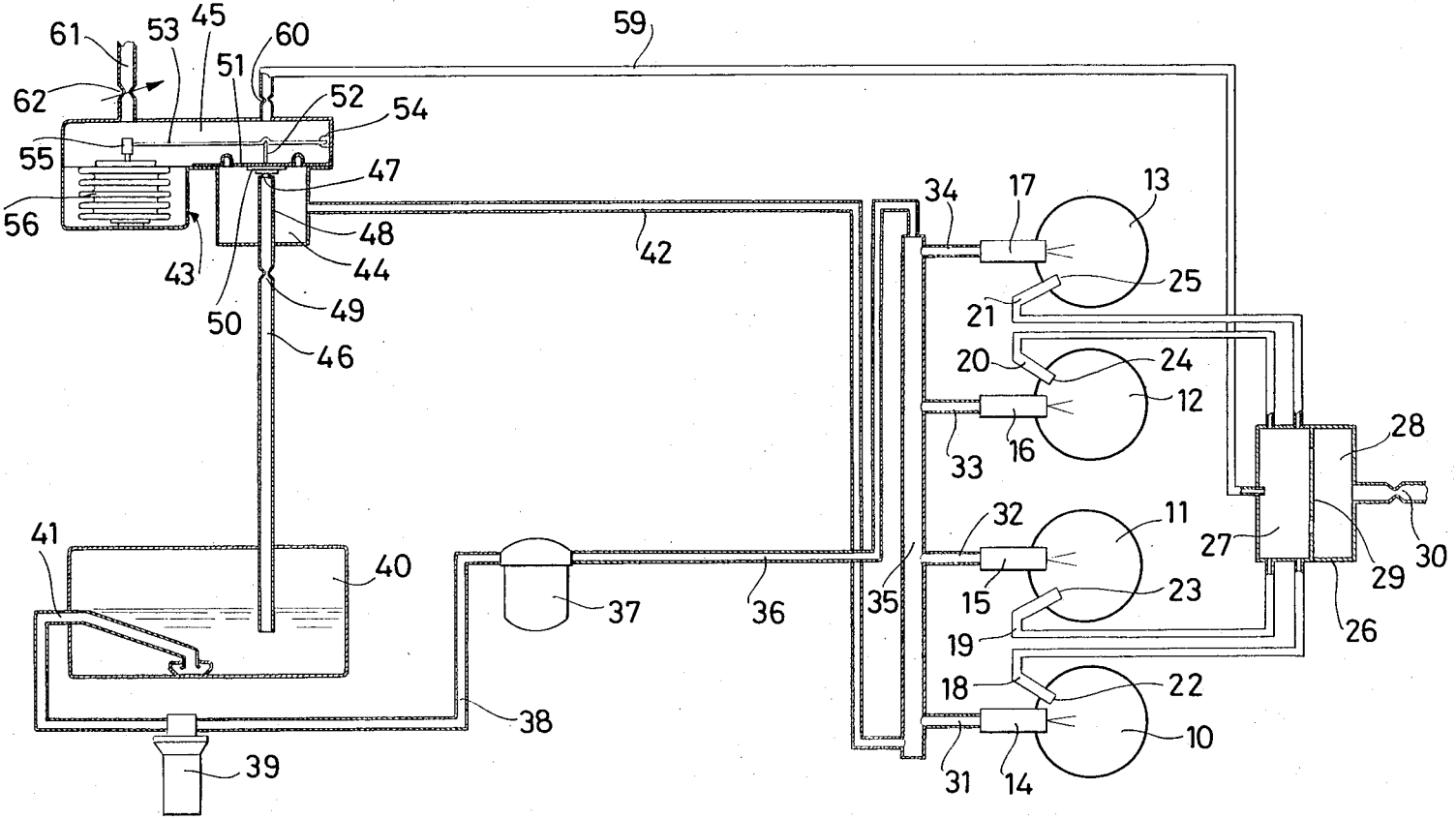

This invention relates to a pressure regulator for petrol injection systems of internal combustion engines, in which the fuel is fed by an electric pump, of which the delivery may not be rigorously constant, to the circuit formed by the injectors which spray it into the engine intake air.

Generally, the pump is sized for delivering a petrol throughput which can be as much as double that consumed by the engine, and thus a regulator is provided in the system to discharge the excess petrol. The main purpose of the regulator is to maintain a predetermined petrol pressure upstream of the injectors independently of delivery variations and of pressure fluctuations of the intake air.

Of known regulators, there are some, such as that described in U.S. Pat. No. 4,231,347, which are constituted by a petrol discharge valve operated by a diaphragm subjected to the pump delivery pressure, to the vacuum of the engine intake air, and to the load of a counteracting spring.

The pressure difference between the pump delivery pressure and intake air vacuum at which the diaphragm remains in equilibrium and keeps the discharge valve closed is chosen by setting the degree of spring preloading. If the pressure difference increases, due to an increase in the pump delivery pressure or in the engine intake air vacuum, the diaphragm causes the discharge valve to open so as to return the excess petrol.

With regulators of this type, the petrol pressure difference between the upstream and downstream sides of the injectors is maintained practically constant both as the engine load varies and as atmospheric pressure varies due to variation in the altitude at which the engine operates. Thus if the cross-section of the jet is constant, the petrol quantity delivered by the injectors is proportional to the injector opening time.

In other types of regulator, the petrol pressure difference between the upstream and downstream sides of the injectors is varied as a function of the load and operating altitude of the engine, so that at low loads and at high altitude (with respect to the reference altitude) the pressure difference is reduced, and the smaller delivered petrol quantities required under these conditions are provided with injector opening times which are longer than those which would have to be used if the pressure difference remained constant.

In these regulators, such as that described in Italian patent No. 1,021,083 of the present applicant, the discharge valve is operated by a diaphragm subjected to a vacuum which varies with the engine intake air throughput.

The object of the present invention is to provide a regulator of this second type, which is constructed in accordance with criteria which improve its efficiency and operability.

The regulator according to the invention comprises a casing provided with a first duct for petrol inlet, a second duct for petrol discharge, and a third duct connected to at least one engine intake duct, the regulator also comprising a valving member engaged with a sized port disposed in said petrol discharge duct, said valving member being connected to a diaphragm, one face of which is subjected to the inlet pressure, its other face being subjected to a pressure which is a function of the engine intake pressure, the regulator being characterised in that said valving member is also operationally connected to an aneroid capsule also subjected to said pressure which is a function of the engine intake pressure.

By this means, the petrol pressure difference between the upstream and downstream sides of the injectors is regulated as a function of the engine intake pressure in accordance with a predetermined relationship which is obtained by superimposing on the proportionality relationship governing the diaphragm, suitable corrections entrusted to the aneroid capsule.

In this manner, for example, a variation relationship of linear type can be obtained which follows a parabolic relationship with good approximation within the range of engine feed pressure and atmospheric pressure variations concerned.

Advantageously, the regulator according to the invention can comprise a casing provided with a fourth duct connected to atmosphere and provided with a variable port.

This enables the initial petrol pressure setting to be made while the engine is idling, in order to adapt the regulator to the engine on which it is mounted.

Furthermore, the second duct of the regulator casing can be advantageously provided with a further sized discharge port in series with said sized petrol discharge port.

This enables a further correction to be applied to the petrol pressure regulation when the engine is operating at high altitude, because as the petrol throughput discharged by said further sized discharge port increases due to lesser engine consumption at high altitude, a pressure recovery occurs which enables a petrol pressure variation relationship to be obtained which even further approximates to a parabolic relationship.

Characteristics and advantages of the invention are described hereinafter with reference to FIGS. 1 and 2, which show a preferred embodiment of the regulator according to the invention by way of non-limiting example.

Figure 2:
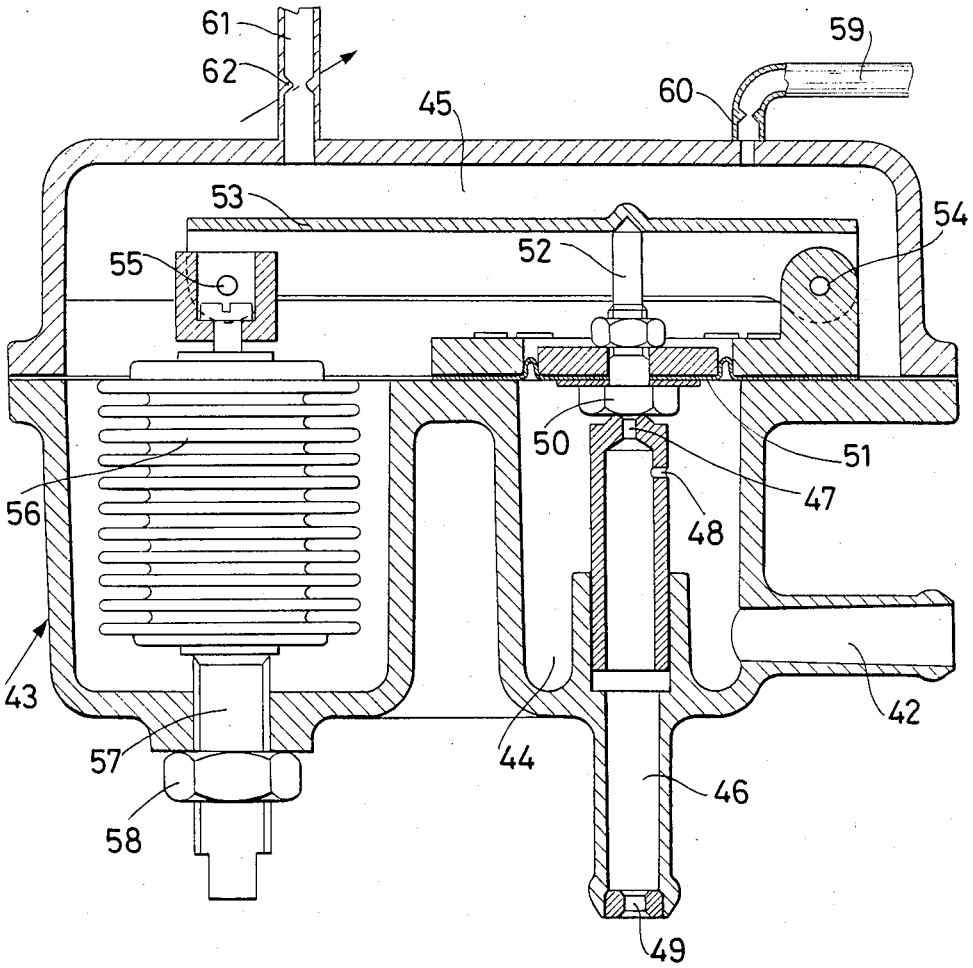

FIG. 1 shows a petrol injection system provided with the pressure regulator according to the invention; and FIG. 2 shows an enlarged section through said regulator.

FIG. 1 diagrammatically shows the intake ducts 10, 11, 12, 13 of a four-cylinder internal combustion engine. The petrol injectors, which in this particular case are electrically operated injectors indicated by 14, 15, 16, 17, are disposed in said ducts, into which there open small ducts 18, 19, 20, 21, which are provided with a respective sized port 22, 23, 24, 25 for feeding to the cylinders that part of the air required for engine idling. The small ducts 18, 19, 20, 21 branch from a body, indicated by 26, which is provided with a chamber 27 and a chamber 28 separated by a perforated wall 29. The chamber 28 is connected to the air filter (not shown) by way of a sized port indicated by 30.

The reference numerals 31, 32, 33, 34 indicate the tubes, branching from the manifold 35, which feed petrol to the injectors 14, 15, 16, 17. The petrol reaches the manifold 35 from a duct 36 by way of a filter 37 communicating with the delivery duct 38 of the pump 39, which draws petrol from the tank 40 through the duct 41. The return duct 42 branches from the manifold 35, and is connected to the casing of the pressure regulator 43.

The pressure regulator, which is shown in detail in FIG. 2, comprises two chambers, one indicated by 44 and the other by 45. The chamber 44 is connected to the duct 42 and is provided with a discharge duct 46 which opens into the tank 40.

Two sized ports 47 and 48 disposed in parallel and a third sized port 49 disposed in series with the first two are provided in the discharge duct 46.

A valving member 50 engages with the sized port 47 and is rigid with a diaphragm 51 which upperly closes the chamber 44 and separates it from the chamber 45.

The valving member 50 is provided with a push rod 52, as shown in detail in FIG. 2, which engages with a lever 53 pivoted at 54 to the regulator casing.

One end of an aneroid capsule, indicated by 56, is pivoted at 55 to the lever 33, and its other end is fixed to the regulator casing by means of the screw 57 and nut 58.

The chamber 45 of the pressure regulator is connected to the body 26 by a duct 59 provided with a sized port 60, and is also connected to the air filter (not shown) by a duct 61 provided with a manually adjustable port, which is indicated diagrammatically in a generic manner by 62.

The purpose of the pressure regulator 43 is to control the petrol pressure difference between the upstream and downstream sides of the injectors 14, 15, 16, 17, as a function of the pressure in the intake ducts 10, 11, 12, 13 which is transmitted to the chamber 45 by way of the chamber 27 of the body 26 and through the duct 59.

The petrol pressure difference between the upstream and downstream sides of the injectors is made to vary substantially linearly with increase in the intake pressure, by the combined action of the diaphragm 51 and aneroid capsule 56 on the valving member 50, as the pressure in the chamber 45 assumes values which are intermediate between atmospheric pressure, transmitted by the duct 61, and the intake pressure, transmitted by the duct 59.

Thus at low loads, when the intake pressure is reduced, the petrol pressure difference between the upstream and downstream sides of the injectors is kept low in order to be able to lengthen the injection times for the low petrol deliveries required under such conditions. At high loads with the intake pressure continuously increasing, because of the fact that the injection times are fairly long the petrol pressure difference between the upstream and downstream sides of the injectors is increased because the petrol delivery required under such conditions is high.

A similar regulation occurs as the altitude at which the engine operates increases. As atmospheric pressure decreases, the petrol pressure difference between the upstream and downstream sides of the injectors decreases, and thus the air/petrol ratio assumes the same values which it would have at zero altitude (reference altitude) for the same intake pressure values.

The valving member 50 closes the discharge port 47 when the force due to the pressure difference across the diaphragm 51 multiplied by the distance of the push rod 52 from the pivot 54 is balanced by the force exerted by the aneroid capsule 56 on the end of the lever 53 multiplied by the distance between the pin 55 and pivot 54. In contrast, when the force acting on the diaphragm 51 exceeds the counteracting force due to the aneroid capsule 56, the valving member 50 rises to open the discharge port 47, which causes petrol to return to the tank 40 in parallel with the always open bleed port 48. When this supplementary discharge port 47 opens, the pressure in the manifold 35 decreases, with consequent decrease in the petrol pressure difference between the upstream and downstream sides of the injectors, so that it returns to its design value.

The regulator is set for engine idling conditions by adjusting the variable port 62, by means of which the ratio of said port 62 to the sized port 60 is changed, in order to define the pressure which arises under these conditions in the chamber 45. In this manner the pressure in the chamber 45 assumes a predetermined value which is intermediate between atmospheric pressure and the pressure, or rather vacuum, present in the ducts 10, 11, 12, 13 when the engine is idling. The presence of the sized port 49 in series with the ports 47 and 48 enables the petrol pressure difference between the upstream and downstream sides of the injectors to be increased during operation at low atmospheric pressure, so as to correct the relationship governing the variation of said pressure difference with atmospheric pressure. In this respect, the presence of the sized port 49 allows a certain pressure recovery upstream of said port 49 and thus in the manifold 35, as the petrol throughput discharged through the ports 47 and 48 increases.

In this manner, the pressure difference variation relationship provided by the regulator, and which is of substantially linear type, is modified so that it more closely approximates to a parabolic variation relationship, this being the optimum.

I claim:

1. A pressure regulator for the petrol circuit of an internal combustion engine injection system provided with intake ducts and injectors disposed in said intake ducts, said circuit comprising a petrol tank, a pump and a delivery duct connected to said injectors, the regulator comprising a casing provided with a first duct for petrol inlet and connected to said delivery duct, a second duct for petrol discharge and connected to said tank, and a third duct connected to at least one engine intake duct, the regulator also comprising a valving member engaged with a sized port disposed in said petrol discharge duct, said valving member being connected to a diaphragm, one face of which is subjected to the inlet petrol pressure, its other face being subjected to a pressure which is a function of the engine intake pressure, the regulator being characterised in that said valving member is also operationally connected to an aneroid capsule also subjected to said pressure which is a function of the engine intake pressure, said third duct having a sized port, and there is a fourth duct connected to atmosphere and having a manually adjustable variable port wherein pressure of petrol to said injectors is a controlled function of intake pressure and atmosphere pressure reacting on both said diaphragm and said aneroid capsule.

2. A regulator as claimed in claim 1, characterised in that said valving member engages with a lever pivoted to the casing of said regulator and connected to said aneroid capsule.

3. A regulator as claimed in claim 1, characterised in that said second duct is provided with a further sized discharge port in series with said sized petrol discharge port.

4. A regulator as claimed in claim 1, characterised in that its casing comprises two chambers separated by said diaphragm, one chamber communicating with said first and second ducts, and the other chamber communicating with said third and fourth ducts.

5. A regulator as claimed in claim 1, characterised in that said third duct is connected to the engine intake ducts by way of a further chamber and a plurality of small ducts provided with respective sized ports, the number of said small ducts being equal to the number of engine intake ducts.

* * * * *